United States Patent [19]

Rist

[11] Patent Number: 4,599,872

[45] Date of Patent: Jul. 15, 1986

[54] POUR THROUGH BEVERAGE CHILLER

[76] Inventor: Wesley G. Rist, 36 River Road, Winnipeg, Manitoba, Canada, R2M 3Z2

[21] Appl. No.: 786,043

[22] Filed: Oct. 10, 1985

Related U.S. Application Data

[63] Continuation-in-part of Ser. No. 679,404, Dec. 7, 1984, abandoned.

[51] Int. Cl.[4] ..... B67D 5/62

[52] U.S. Cl. ..... 62/399; 62/400; 62/430

[58] Field of Search ..... 62/293, 400 H, 430, 62/434, 438, 439, 399 C; 165/163; 222/146 C

[56] References Cited

U.S. PATENT DOCUMENTS

| | | | |
|---|---|---|---|
| 528,463 | 10/1914 | Busch | 62/293 X |
| 1,954,369 | 4/1934 | Solomon | 62/400 X |
| 2,039,736 | 5/1936 | Munters et al. | 62/430 |
| 2,285,096 | 6/1942 | Sailer et al. | 62/400 X |
| 2,425,596 | 8/1947 | Carter | 62/400 |
| 2,716,871 | 9/1955 | Brown | 62/293 |
| 4,204,613 | 5/1980 | Terzian et al. | 62/400 X |
| 4,407,356 | 10/1983 | De Lau | 62/400 X |
| 4,478,346 | 10/1984 | Spong | 62/400 X |

*Primary Examiner*—Lloyd L. King
*Attorney, Agent, or Firm*—Stanley G. Ade

[57] ABSTRACT

Cooling beverages by the addition of ice cubes, dilutes the beverage as the ice melts. The present device comprises an insulated container having a low freezing temperature material such as a liquid or semi-liquid, sealed therein. A pouring funnel is provided at the upper end of the container with a spiral conduit extending from the funnel, downwardly through the liquid or material, to a discharge at the base. When frozen, a beverage can be poured into the funnel portion and flows downwardly through the conduit being cooled by the material within the container and surrounding the conduit. The liquid then discharges at the base at a relatively lower temperature. A valve can be provided in the base for controlling the retention time, if desired.

20 Claims, 8 Drawing Figures

POUR THROUGH BEVERAGE CHILLER

BACKGROUND OF THE INVENTION

This invention relates to new and useful improvements in what might be termed as "pour through beverage chilling devices" and is a continuation in part of application Ser. No. 679,404 filed Dec. 7, 1984 and now abandoned.

The conventional way of cooling beverages, apart from placing them in a refrigerator for a considerable length of time, is to add ice cubes to the beverage. This is particularly true of mixed beverages in which several ingredients may be incorporated either by mixing or blending. Examples include milkshakes, alcoholic beverages and the like. Unfortunately, as the ice cubes melt in order to cool the beverage, the beverage is diluted with the resultant water and this is not always satisfactory to the consumer.

SUMMARY OF THE INVENTION

The present device overcomes these disadvantages by providing a chilling container which may be kept in the freezer compartment of a refrigerator until required. When it is desired to chill a beverage, the device is removed from the refrigerator and the beverage poured through the device into a container such as a glass situated therebelow.

This is accomplished by providing the beverage cooling device with an insulated container, a beverage receiving portion at the upper end of said container in sealed relationship therewith, a discharge at the base of said container in sealed relationship therewith and at least on conduit extending from said beverage receiving portion, downwardly through said container to said discharge, and a relatively low freezing point material in said container and surrounding said conduit.

Another advantage of the invention is desirable addition of a flow control valve at the base of the device which can control the retention time of the liquid within the container as it passes therethrough thus enabling a greater cooling effect to be obtained.

Under many circumstances, the device will chill several drinks before the cooling liquid or material within the container absorbs sufficient heat to require the container to be refrozen.

Another advantage of the invention is to provide a device which can be free-standing on a supporting surface, can be engaged within the upper end of a further container such as a glass or the like or can be engaged upon a further similar device so that a double chilling capacity may be obtained.

A yet further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
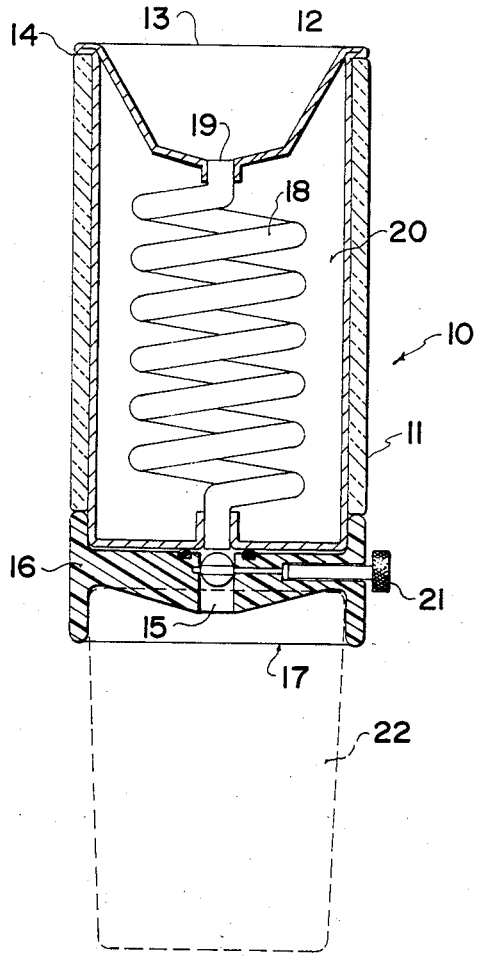
FIG. 1 is a fragmentary cross-sectional view of one embodiment of the invention substantially along the line 1—1 of FIG. 2.
Figure 2:
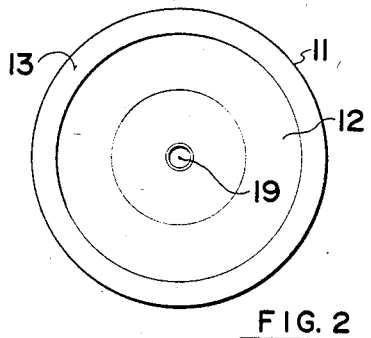
FIG. 2 is a top plan view of FIG. 1.
Figure 3:
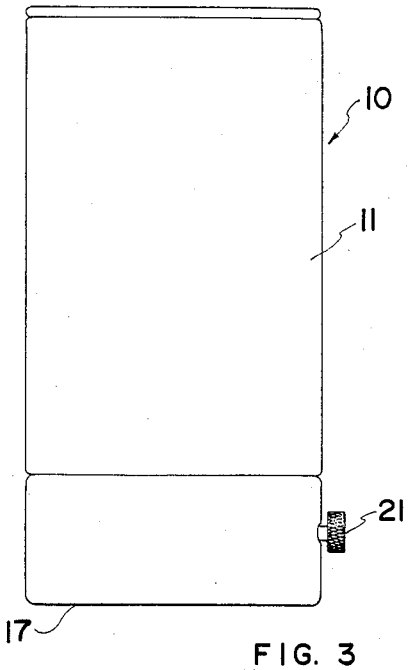
FIG. 3 is a front elevation of FIG. 1.

Proceeding therefore to describe the invention in detail, reference should first be made to FIG. 1 in which reference character 10 illustrates generally, an enclosure or container consisting of a cylindrical outer wall 11 which is preferably formed from an insulating material or which incorporates insulation of a conventional type.

Situated within the upper end of the perimetrical wall forming the container, is a funnel shaped beverage receiving portion 12 which is sealed into the upper end of the wall by conventional sealing material (not illustrated) with the upper side or edge 13 of the wall being substantially flush with the upper end 14 of the wall 11.

A discharge aperture or bore 15 is formed within a cone shaped base 16 formed within the lower end portion of the wall but spaced upwardly from the hollow base 17 an amount sufficient to enclose all of the cone shaped element 16. This cone shaped element is also sealed to the inner surface of the wall by conventional means.

A conduit 18 communicates with the base of the beverage receiving portion 12 as at 19 and extends downwardly through the container to be connected to the discharge 15 and the length of this conduit is greater than the distance between the base 19 and the discharge 15 and is preferably in the form of a spiral as clearly shown in FIG. 1. It should be appreciated that the beverage receiving portion 12, the conduit 18, and the discharge are sealed from the interior 20 of the container which contains a low freezing temperature liquid or semi-liquid or other type of material and which completely surrounds the conduit 18. An example is alcohol which has a lower freezing point than water but other materials including liquids, gels and granular material, may be used and are well known in the art of freezable pouches, bags and the like.

A control valve 21 of conventional construction and operation may be inserted within the discharge 15 and controlled externally in a conventional manner.

Figure 4:
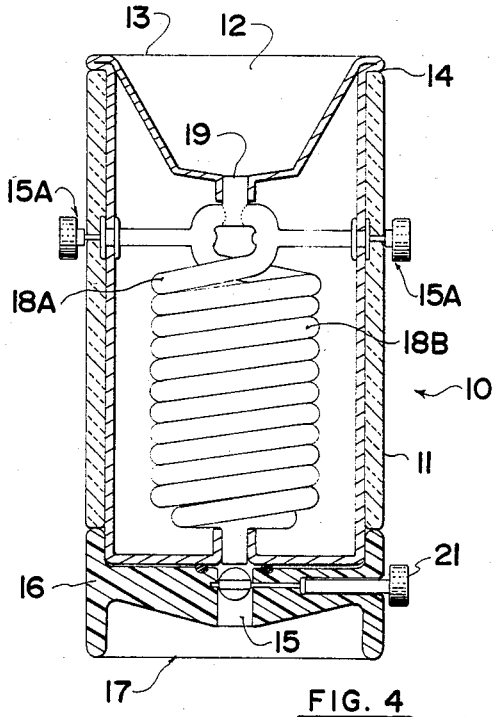
FIG. 4 is a view similar to FIG. 1 but showing an alternative embodiment.

An alternative embodiment is shown in FIG. 4 in which a pair of contra-spiralling conduits 18A and 18B are provided both being connected to the base 19 of the beverage receiving portion and both being connected to the discharge 15.

If desired, a further conventionally operating control valve 15A may be provided upon each spiral conduit 18A and 18B adjacent the upper ends thereof.

In operation, the device is kept within the freezer compartment of a refrigerator or within a conventional freezer until required whereupon it may be placed upon a container such as a glass 22. The conical portion 16 facilitating engagement of the glass within the lower end portion of the casing wall 11.

The beverage to be chilled is then poured into the beverage receiving portion 12 at a rate slow enough to prevent overflowing whereupon the beverage flows through the coil 18 being cooled by the refrigerating substance within the container to discharge into the container 22 below. If necessary, the flow control valve can be adjusted to adjust the retention time of the liquid within the conduit 18 or, alternatively, it can be shut off completely so that no flow occurs until the valve is once again opened.

In the embodiment shown in FIG. 4, the beverage may be routed through either one or both of the conduits 18A or 18B by valves 15A depending upon circumstances and the amount of chilling desired together with the temperature of the liquid surrounding the conduits.

The refrigerating substance within the container and surrounding the conduits should preferably consist of a liquid with a relatively low coefficient of expansion or a eutectic solution of salts having melting or freezing points below the freezing point of water and within the normal range of temperatures of the refrigeration. Their coefficient of expansion on freezing also should be appreciably less than that of water.

Many such substances are well known in the art as are refrigerating gels used in freezer bags and the like.

The downwardly depending portion of the wall 11 at the lower end thereof enables the device to be supported upon a flat surface such as a table top, when not in use upon a container because the diameter thereof is approximately similar to the diameter of the wall 11 forming the container. This also facilitates supporting the device within the freezer compartment.

Figure 5:
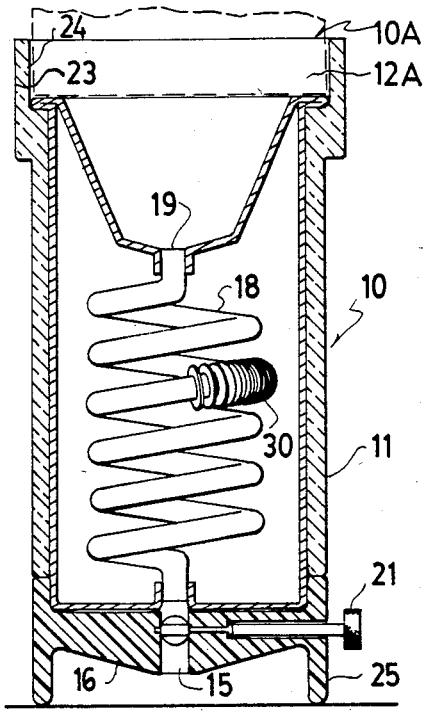
FIG. 5 is a view similar to FIG. 1 but showing the preferred embodiment.

FIG. 5 shows the preferred embodiment of the invention which is similar in construction to the embodiment described in FIG. 1 with the except that it will be noted that the beverage receiving portion 12A includes an upwardly extending annular shoulder 23, the inner diameter 24 of which is slightly larger than the outer diameter of the lower wall portion 25 of the container so that a further container indicated fragmentarily in phantom and by reference character 10A, may engage snuggly in stacked relationship thereupon so that a double capacity is provided with liquid being poured in the upper end of the similar container 10A and then after passing through the chilling section thereof, enters the receiver portion 12A of the lower most container and passes through the chilling portion thereof. It is to be understood that the further container 10A is identical in construction to the container shown in FIG. 5.

It should also be understood that the container shown in FIG. 5 can, if desired, be provided with the twin tubing and control valve arrangements shown and described in FIG. 4.

Figure 6:
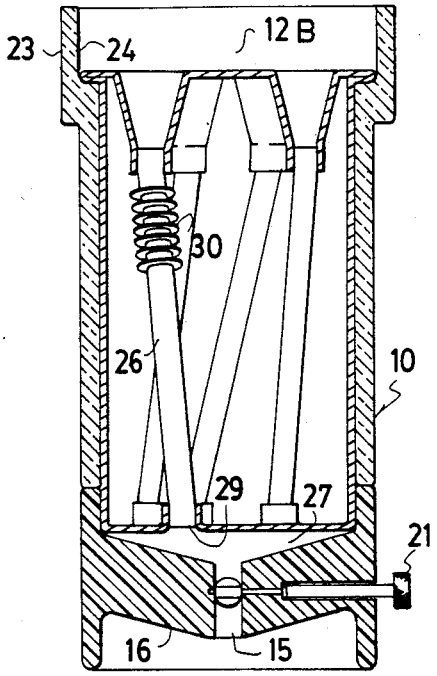
FIG. 6 is a view similar to FIG. 5 but showing an alternative arrangement of the tubes.
Figure 7:
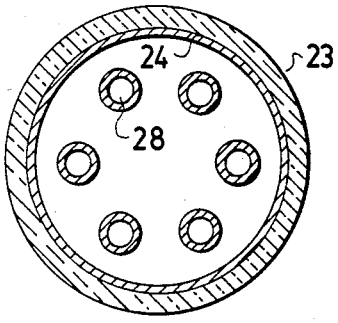
FIG. 7 is a top plan view of FIG. 6.

FIG. 6 shows a device similar to that illustrated in FIG. 5 but with a plurality of cooling tubes 26 situated in annular array and inclined from the vertical. These tubes, which are in spaced and parallel relationship, extend from the beverage receiving portion 12B to a discharge or collector area 27. Each tube has an individual upper end 28 and an individual lower end 29. Common parts such as the cone-shaped base 16 and valve 21 have been given similar reference characters.

Figure 8:
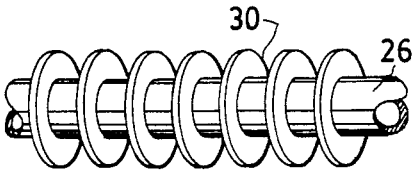
FIG. 8 is a fragmentary isometric view of a portion of the finned embodiment of the tubing.

In any of the embodiments described and illustrated in this application, the tubes or conduits 18 or 26 may be provided with radially extending fins 30 as shown in FIGS. 6 and 8, which improve the heat transfer or heat conducting characteristics of the tubes which of course are surrounded with the freezeable material hereinbefore described.

The device can chill a beverage faster and more thoroughly than ice cubes in or on and around a container of beverage.

The coolant liquid or other coolant material inside is preferred not to freeze under normal freezer operating temperatures.

The two spiral system may have one spiral running inside of the other from a top view, with distance between, if desired.

The outlet flow valve may be thermostatically controlled so as to open only when a predetermined low temperature is reached.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A beverage cooling device comprising in combination an insulated container, a beverage receiving portion at the upper end of said container in sealed relationship therewith, a discharge at the base of said container in sealed relationship therewith and at least one conduit extending between said beverage receiving portion, downwardly through said container to said discharge and in sealing relationship therewith, a relatively low freezing point material in said container surrounding said conduit and being permanently sealed within said contained, said container including a perimetrical wall extending downwardly below said discharge, the diameter of said wall being at least substantially equal to the diameter of said casing and being selectively engageable around the upper end of a receiving container, the lower side of said perimetrical wall being perpendicular to the vertical axis of said device for supporting same on a planar horizontal surface, said discharge including a downwardly extended cone-shaped portion to facilitate engagement of said device with the associated receiving container, said discharge extending through said cone-shaped portion and terminating above the lower side of said perimetrical wall.

2. The device according to claim 1 which includes a valve in said discharge to control the retention time of the beverage within said conduit.

3. The device according to claim 1 in which the length of said conduit exceeds the distance between the beverage receiving portion and said discharge.

4. The device according to claim 2 in which the length of said conduit exceeds the distance between the beverage receiving portion and said discharge.

5. The device according to claim 2 in which said conduit is in the form of a spiral coil.

6. The device according to claim 1 in said conduit includes a plurality of conduits in annual array, said conduits being inclined from the perpendicular and lying in spaced and parallel relationship with another, each of said conduits extending between said beverage receiving portion and an individual discharge at the base of said container.

7. The device according to claim 1 which includes a pair of conduits extending between said beverage receiving portion and said discharge in contraspiral relationship with one another and an independent control valve for each of said conduits adjacent the connection thereof to said beverage receiving portion.

8. The device according to claim 2 which includes a pair of conduits extending between said beverage receiving portion and said discharge in contraspiral relationship with one another and an independent control valve for each of said conduits adjacent the connection thereof to said beverage receiving portion.

9. A beverage cooling device selectively engageable with a receiving container, comprising in combination an insulated container, a beverage receiving portion at the upper end of said container in sealed relationship therewith, a discharge at the base of said container in sealed relationship therewith, at least one conduit extending from said beverage receiving portion, downwardly through said container to said discharge, and a relatively low freezing point material in said container and surrounding said conduit permanently sealed within said container, said container including a perimetrical wall, said wall extending downwardly below said discharge and being selectively engageable around the upper end of a receiving container, the lower side of said perimetrical wall being perpendicular to the vertical axis of said device for supporting same on a planar horizontal surface, said discharge including a downwardly extending cone-shaped portion to facilitate engagement with said receiving container, said discharge extending through said cone-shaped portion, the inner diameter of said beverage receiving portion being greater than the outer diameter of said lower side of said perimetrical wall of said container to receiver the lower perimetrical wall of a similar cooling device in stacked relationship thereon.

10. The device according to claim 9 which includes a valve in said discharge to control the retention time of the beverage within said conduit.

11. The device according to claim 9 in which the length of said conduit exceeds the distance between the beverage receiving portion and said discharge.

12. The device according to claim 10 in which the length of said conduit exceeds the distance between the beverage receiving portion and said discharge.

13. The device according to claim 9 in which said conduit is in the form of a spiral coil.

14. The device according to claim 9 in said conduit includes a plurality of conduits in annual array, said conduits being inclined from the perpendicular and lying in spaced and parallel relationship with another, each of said conduits extending between said beverage receiving portion and an individual discharge at the base of said container.

15. The device according to claim 9 which includes a pair of conduits extending between said beverage receiving portion and said discharge in contraspiral relationship with one another and an independent control valve for each of said conduits adjacent the connection thereof to said beverage receiving portion.

16. The device according to claim 10 which includes a pair of conduits extending between said beverage receiving portion and said discharge in contraspiral relationship with one another and an independent control valve for each of said conduits adjacent the connection thereof to said beverage receiving portion.

17. The device according to claim 11 which includes a pair of conduits extending between said beverage receiving portion and said discharge in contraspiral relationship with one another and an independent control valve for each of said conduits adjacent the connection thereof to said beverage receiving portion.

18. The device according to claim 12 which includes a pair of conduits extending between said beverage receiving portion and said discharge in contraspiral relationship with one another and an independent control valve for each of said conduits adjacent the connection thereof to said beverage receiving portion.

19. The device according to claim 1 in which the inner diameter of said beverage receiving portion is greater than the outer diameter of the lower end of said container to receive the lower end of a similar container in stacked relationship therewith.

20. The device according to claim 19 which includes a valve in said discharge to control the retention time of the beverage within said conduit.

* * * * *